US009989217B2

(12) United States Patent
Jurik et al.

(10) Patent No.: US 9,989,217 B2
(45) Date of Patent: Jun. 5, 2018

(54) BEAM FRAMING SYSTEM FOR AN AUTOMATED LUMINAIRE

(71) Applicant: Robe Lighting s.r.o., Roznov pod Radhostem (CZ)

(72) Inventors: Pavel Jurik, Prostredni Becva (CZ); Josef Valchar, Prostredni Becva (CZ)

(73) Assignee: Robe Lighting s.r.o., Roznov pod Radhostem (CZ)

( * ) Notice: Subject to any disclaimer, the term of this patent is extended or adjusted under 35 U.S.C. 154(b) by 0 days. days.

(21) Appl. No.: 14/386,314

(22) PCT Filed: Mar. 18, 2013

(86) PCT No.: PCT/US2013/032848
§ 371 (c)(1),
(2) Date: Sep. 18, 2014

(87) PCT Pub. No.: WO2013/142435
PCT Pub. Date: Sep. 26, 2013

(65) Prior Publication Data

US 2015/0300604 A1 Oct. 22, 2015

Related U.S. Application Data

(60) Provisional application No. 61/612,373, filed on Mar. 18, 2012.

(51) Int. Cl.
*F21S 8/00* (2006.01)
*F21V 14/08* (2006.01)
(Continued)

(52) U.S. Cl.
CPC ..... *F21V 14/08* (2013.01); *F21V 5/04* (2013.01); *F21V 11/186* (2013.01); *F21V 5/008* (2013.01);
(Continued)

(58) Field of Classification Search
CPC ..... F21V 14/08; F21V 5/04; F21V 11/186; F21V 5/008; F21V 5/045; F21V 14/06;
(Continued)

(56) References Cited

U.S. PATENT DOCUMENTS 1,738,945 A 12/1929 Brenkert et al.
1,767,756 A 6/1930 Hall
(Continued)

FOREIGN PATENT DOCUMENTS

CN 201326976 Y 10/2009
CN 101925776 A 12/2010
(Continued)

OTHER PUBLICATIONS

PCT International Search Report; Application No. PCT/US2013/032848; dated Jul. 1, 2013; 4 pages.
(Continued)

*Primary Examiner* — Anh Mai
*Assistant Examiner* — Glenn Zimmerman
(74) *Attorney, Agent, or Firm* — Conley Rose, P.C.; Grant Rodolph; Brooks W Taylor

(57) ABSTRACT

Described are an improved automated luminaire and automated luminaire system with both a spot light and wash light mode of operation, which employs an improved beam shutter blade system that serves as framing shutters in spot light mode and barn doors in wash light mode.

6 Claims, 10 Drawing Sheets

(51) Int. Cl.

| | |
|---|---|
| ***F21V 11/18*** | (2006.01) |
| *F21V 5/00* | (2018.01) |
| *F21V 5/04* | (2006.01) |
| *F21V 14/06* | (2006.01) |
| *F21W 131/406* | (2006.01) |
| *F21Y 101/00* | (2016.01) |
| *F21Y 115/10* | (2016.01) |

(52) U.S. Cl.
CPC ..... *F21V 5/045* (2013.01); *F21V 14/06* (2013.01); *F21W 2131/406* (2013.01); *F21Y 2101/00* (2013.01); *F21Y 2115/10* (2016.08)

(58) Field of Classification Search
CPC ..... F21Y 2101/02; F21Y 2101/00; F21Y 2115/10; F21W 2131/406
USPC ..... 362/282, 280, 321
See application file for complete search history.

(56) References Cited

U.S. PATENT DOCUMENTS

| | | | | |
|---|---|---|---|---|
| 2,076,240 | A | 4/1937 | Levy | |
| 3,153,996 | A * | 10/1964 | Rentschler | G03B 9/22 396/497 |
| 4,208,100 | A | 6/1980 | Bischl | |
| 4,456,783 | A | 6/1984 | Baker | |
| 4,468,720 | A | 8/1984 | Arai | |
| 4,630,902 | A | 12/1986 | Mochizuki et al. | |
| 4,867,514 | A | 9/1989 | Waldron | |
| 4,890,208 | A | 12/1989 | Izenour | |
| 5,502,627 | A * | 3/1996 | Hunt | H05B 37/029 318/603 |
| 5,580,164 | A | 12/1996 | Maddox et al. | |
| 5,665,305 | A | 9/1997 | Belliveau et al. | |
| 5,758,955 | A | 6/1998 | Belliveau | |
| 5,980,066 | A | 11/1999 | Belliveau et al. | |
| 6,282,027 | B1 | 8/2001 | Hough | |
| 6,474,837 | B1 | 11/2002 | Belliveau | |
| 6,550,939 | B2 | 4/2003 | Reinert | |
| 6,744,693 | B2 | 6/2004 | Brockmann et al. | |
| 6,809,869 | B2 | 10/2004 | Hough | |
| 6,939,026 | B2 | 9/2005 | Gennrich et al. | |
| 7,152,996 | B2 | 12/2006 | Luk | |
| RE41,240 | E | 4/2010 | Hough | |
| 2004/0017685 | A1 * | 1/2004 | Dedoro | F21V 5/045 362/268 |
| 2005/0098553 | A1 * | 5/2005 | Devine | F27B 17/0025 219/411 |
| 2005/0231957 | A1 | 10/2005 | Wynne Willson | |
| 2008/0101067 | A1 * | 5/2008 | Cariboni | F21V 5/04 362/245 |
| 2008/0137345 | A1 * | 6/2008 | Wimberly | F21V 3/04 362/299 |
| 2009/0268466 | A1 | 10/2009 | Allegri | |
| 2010/0097808 | A1 * | 4/2010 | Jurik | F21V 21/15 362/296.01 |
| 2010/0103677 | A1 * | 4/2010 | Belliveau | F21V 5/04 362/277 |
| 2011/0110090 | A1 * | 5/2011 | Jurik | F21V 21/15 362/249.07 |
| 2011/0222290 | A1 * | 9/2011 | Cavenati | F21V 11/18 362/277 |
| 2011/0227507 | A1 * | 9/2011 | Salm | F21S 10/02 315/312 |
| 2012/0230039 | A1 * | 9/2012 | Hansen Ellevang | F21V 11/18 362/351 |
| 2012/0288270 | A1 * | 11/2012 | Aab | G03B 9/22 396/493 |

FOREIGN PATENT DOCUMENTS

| | | | |
|---|---|---|---|
| CN | 102252277 | A | 11/2011 |
| EP | 1384941A2d | | 1/2004 |
| GB | 2270969 | A | 3/1994 |
| WO | 9636834 | A1 | 11/1996 |
| WO | 03023513 | A1 | 3/2003 |
| WO | WO 2011029449 | A1 * | 3/2011 |
| WO | WO2011032057 | | 3/2011 |
| WO | WO 2011088984 | A1 * | 7/2011 |

OTHER PUBLICATIONS

PCT Written Opinion of the International Searching Authority; Application No. PCT/US2013/032848; dated Jul. 1, 2013; 6 pages.
Chinese Office Action; Application No. 201380025136.1 dated Mar. 1, 2017; 11 pages.

* cited by examiner

BEAM FRAMING SYSTEM FOR AN AUTOMATED LUMINAIRE

CROSS-REFERENCE TO RELATED APPLICATIONS

This application is a U.S. National Stage Application of International Patent Application No. PCT/US2013/032848 filed on Mar. 18, 2013 by Pavel Jurik, et al. entitled, "Beam Framing System for an Automated Luminaire", which claims priority to U.S. Provisional Application No. 61/612,373 filed on Mar. 18, 2012 by Pavel Jurik, et al. entitled, "Beam Framing System for an Automated Luminaire".

TECHNICAL FIELD OF THE INVENTION

The present invention generally relates to automated luminaires, specifically to optical systems for use within automated luminaires.

BACKGROUND OF THE INVENTION

Luminaires with automated and remotely controllable functionality are well known in the entertainment and architectural lighting markets. Such products are commonly used in theatres, television studios, concerts, theme parks, night clubs and other venues. A typical product will commonly provide control over the pan and tilt functions of the luminaire allowing the operator to control the direction the luminaire is pointing and thus the position of the light beam on the stage or in the studio. Typically this position control is done via control of the luminaire's position in two orthogonal rotational axes usually referred to as pan and tilt. Many products provide control over other parameters such as the intensity, color, focus, beam size, beam shape and beam pattern. The beam pattern is often provided by a stencil or slide called a gobo which may be a steel, aluminum or etched glass pattern. The products manufactured by Robe Show Lighting such as the ColorSpot 700E are typical of the art.

It is well known to design the optical systems of such automated luminaires such that the output angle of the emitted light beam can be adjusted over a range of values, from a very narrow beam to a wide beam. This beam angle size, or zoom, range allows the lighting designer full control over the size of a projected image, pattern or wash area. It is also known to provide means for adjusting the shape of the beam with flags or framing shutters so as to be able to mask the final output beam and control its edges. These flags or framing shutters are typically straight edged so that inserting them into the beam masks an area in a straight line. These flags or framing shutters may be inserted manually into the beam or may use motorized systems to both insert and remove and optionally rotate each flag or shutter. The prior art systems are often very complex mechanically and add substantial weight and cost to a luminaire.

Framing shutter systems are most commonly constructed as a plurality of metal plates or blades that may be individually and separately inserted across the light beam to mask a portion of that beam. Each blade may be completely removed from the light beam or may be adjusted to occlude a portion of the light beam. It is possible to use any number of blades; however, it is common to utilize four blades, allowing framing the projected image to common rectangular shapes such as picture frames. It is also well known to provide individual angular control for each blade, such that the four blades do not have to remain at a fixed, perpendicular angle to each other and thus irregular trapezoidal or triangular shapes may be formed by combinations of the blades.

The prior art contains various examples of such framing shutter systems. For example, U.S. Pat. No. 1,793,945 illustrates a four blade system where each blade may be manually adjusted to cover a portion of the light beam. This system does not provide beam rotation. U.S. Pat. No. 4,890,208 to Izenour discloses a further four blade system where each blade is provided with two motors such that both the position and angle of each blade can be remotely adjusted. U.S. Patent Application Publication No. 2005/02319578 to Wynne-Willson discloses yet a further system where each blade can be remotely adjusted for position and rotation and may also be rotated around the beam. Wynne-Willson further discloses that each blade may have two selectable edges which may be optionally inserted across the beam. He illustrates this as a straight edge or a curved edge. This offers some advantage to the user as shapes other than straight sided polygons can be framed; however, the system disclosed is limited to two edge shapes, and is a very complex mechanism which would be expensive and difficult to manufacture. Further mechanisms are disclosed in U.S. Pat. No. 6,550,939, U.S. Pat. No. 6,744,693, U.S. Pat. No. 6,939,026, PCT Patent Application No. WO 03/023513, PCT Patent Application No. WO 96/36384, and UK Patent No. GB2270969. All of these offer some means for framing at least two sides of a light beam and may also provide position and rotation of each blade.

All the systems disclosed are designed for hard edged luminaires where images are in sharp focus; however, it is common to use soft edged or wash light systems in an entertainment application so as to provide evenly illuminated washes across a stage, set, or scenic background. It would be useful to be able to provide soft edged framing or masking for such a luminaire. This is similar in concept to the barn door systems commonly used with theatrical luminaires, where four edges of the beam may be individually adjusted and the entire system rotated, however the individual angles of each of the four sides may not be adjusted.

FIG. 1 illustrates a multiparameter automated luminaire system 10. These systems commonly include a plurality of multiparameter automated luminaires 12 which typically each contain on-board a light source, light modulation devices, electric motors coupled to mechanical drives systems, and control electronics (not shown). In addition to being connected to mains power, either directly or through a power distribution system (not shown), each luminaire is connected is series or in parallel to data link 14 to one or more control desks 15. The automated luminaire system 10 is typically controlled by an operator through the control desk 15.

FIG. 2 illustrates a prior art automated luminaire 11. A lamp 21 contains a light source 22 which emits light. The light is reflected and controlled by reflector 20 through color modulation components 23, which may include dichroic color filters, effects glass, and other optical devices well known in the art and then through an aperture or imaging gate 24. Optical components 25 are the imaging components and may include gobos, rotating gobos, iris and framing shutters. The beam may then pass through further lenses 26 and 28 before being transmitted through output lens 31. Lenses 26 and 28 may be moved along the optical axis 19 so as to alter the beam angle and focus of the emitted beam. Lenses 26 and 28 are commonly known as the focus and zoom lens, however these common names are really misnomers as both lenses affect both functions. Output lens 31 may be a glass lens or equivalent Fresnel lens.

There is a need for a simplified automated framing shutter mechanism for an automated luminaire which provides the user with simple edge control that can also provide soft edges in a wash light system.

BRIEF DESCRIPTION OF THE DRAWINGS

For a more complete understanding of the present invention and the advantages thereof, reference is now made to the following description taken in conjunction with the accompanying drawings in which like reference numerals indicate like features and wherein.

DETAILED DESCRIPTION OF THE INVENTION

Preferred embodiments of the present invention are illustrated in the FIGUREs, like numerals being used to refer to like and corresponding parts of the various drawings.

The present invention generally relates to an automated luminaire, specifically to the configuration of the optical systems within such a luminaire to provide the ability to obtain a wide range of zoom angles, while still providing a compact unit for rigging, storage and transportation.

Figure 1:
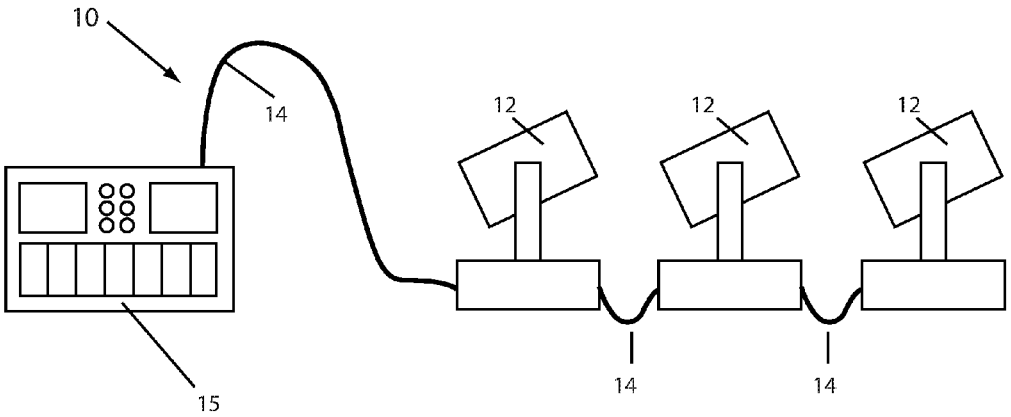
FIG. 1 illustrates a multiparameter automated luminaire system.
Figure 2:
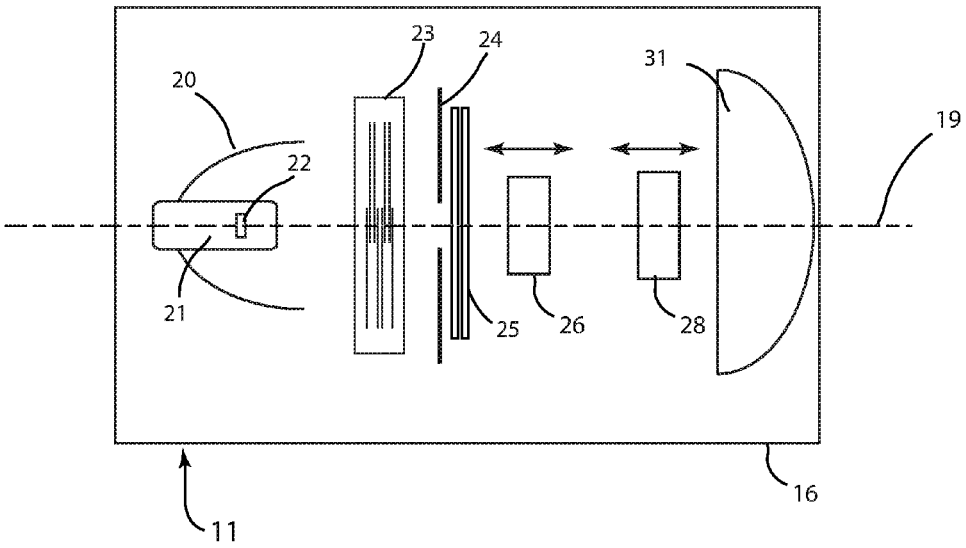
(prior art) FIG 2
FIG. 2 illustrates a prior art automated luminaire.
Figure 3:
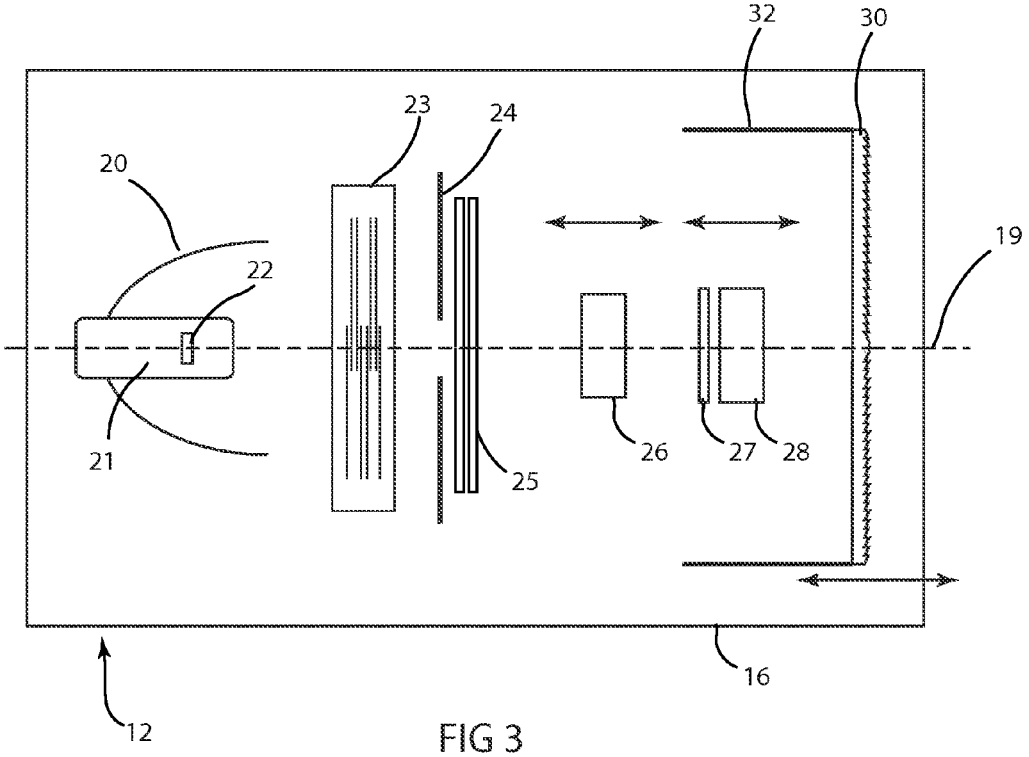
FIG. 3 illustrates an embodiment of an improved beam framing system in an automated luminaire.

FIG. 3 illustrates an embodiment of an improved beam framing system in an automated luminaire. Automated luminaire 12 may contain a lamp 21 and reflector 20 where the lamp and reflector may be moved relative to each other for beam hot-spot control, color modulation components 23 which may include, but are not limited to, color mixing flags or wheels, color wheels and other dichroic color control components, an imaging gate 24 which may be fixed in size or adjustable, imaging optical components which may include but are not limited to gobos, rotating gobos, framing shutters 25, beam shapers, variable frost filters, prisms and iris. The light beam from these images is focused by first lens 26, second lens 28, and Fresnel output lens 30. First lens 26 and second lens 28 may each comprise one or more optical elements, all or some of which may be moved backwards and forwards along the optical axis 19 of the automated luminaire 12 so as to direct light towards output lens 30. First lens 26 and second lens 28 may further homogenize and constrain the light beam and ensure that the light beam entirely fills output lens 30. Diffusion filter 27 may also optionally be inserted in the optical path to improve the homogenization and to further increase the maximum output angle. Output lens 30 may be a conventional Fresnel lens, an improved Fresnel lens with an increased number of smaller circumferential facets than a standard Fresnel lens, or a standard spherical or aspheric lens. First lens 26, second lens 28, and output lens 30 may be manufactured of glass, suitable transparent polymer such as acrylic or polycarbonate, or any other material as known in the art. Output lens 30 may be moved backwards and forwards along the optical axis 19 of the automated luminaire 12 so as to provide focus adjustment of the projected images of optical elements 25. The combination of first lens 26, second lens 28 and output lens 30 provide an output beam which is adjustable for both beam angle and focus by moving any or all of first lens 26, second lens 28 and output lens 30 backwards and forwards along optical axis 19. Output lens 30 is attached to a carrier 32 which supports output lens 30 and provides the movement along the optical axis. Framing shutters 25 may be adjusted to occlude a portion of the projected light beam. Framing shutters 25 may provide either a hard edged focused occlusion or a soft edged wash occlusion. The insertion of diffusion filter 27 in the optical path may further soften the projected edge of framing shutters 25.

Figure 4:
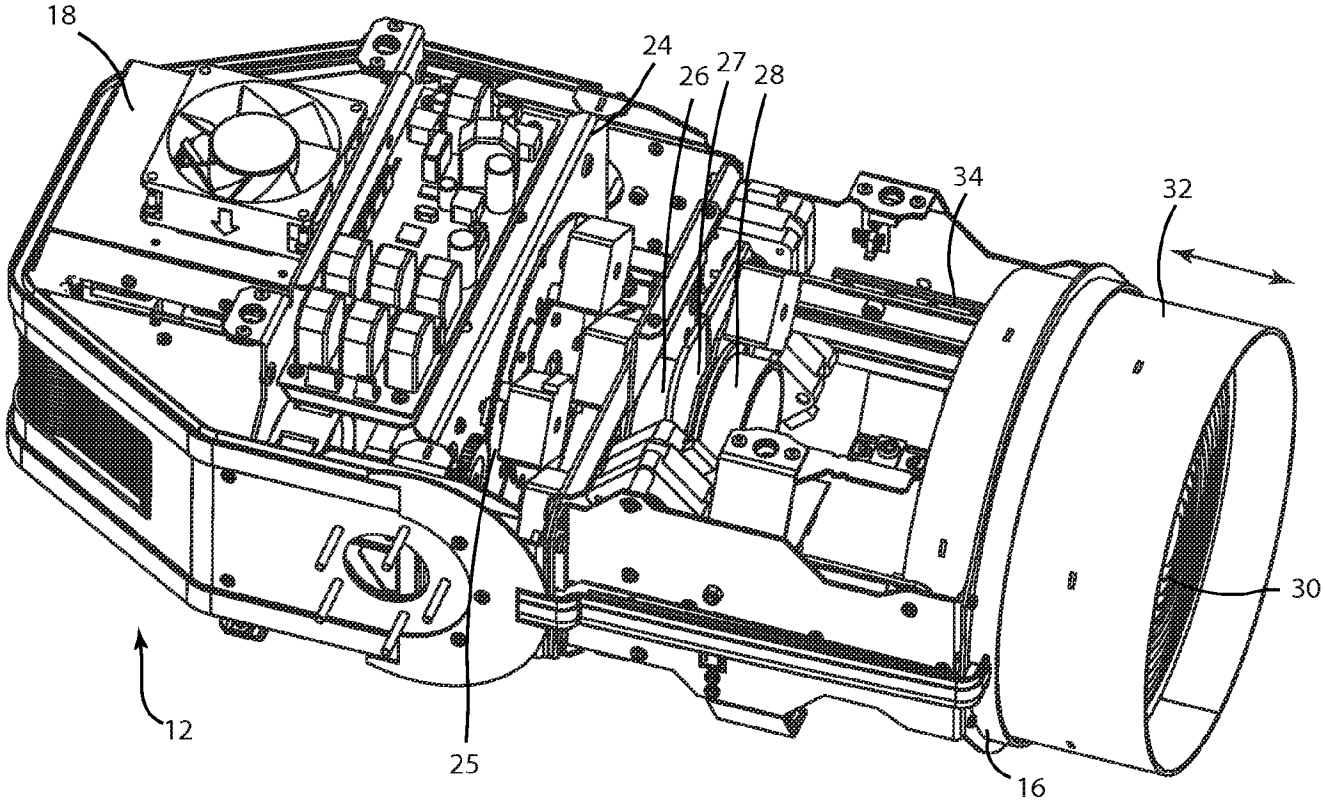
FIG. 4 illustrates an embodiment of an improved beam framing system in an automated luminaire.

FIG. 4 illustrates an embodiment of an improved beam framing system in an automated luminaire. FIG. 4 illustrates the system in a narrow angle configuration where output lens 30 is positioned outside the luminaire chassis 16 and first and second lenses 26 and 28 move to provide zoom and focus. Framing shutters 25 may be adjusted to occlude a portion of the projected light beam. Diffusion filter 27 may also optionally be inserted in the optical path to improve the homogenization and to further increase the maximum output angle. Framing shutters 25 may provide either a hard edged focused occlusion or a soft edged wash occlusion. The insertion of diffusion filter 27 in the optical path may further soften the projected edge of framing shutters 25.

Through the system provided by carrier 32 and output lens 30, whose movement is constrained by rail(s) 34 along the light beam axis, the luminaire is capable of providing a very wide range of output beam angles. In one embodiment the described system provides a continuous zoom range of 5.5° in narrow angle to 60° in wide angle. In this specific embodiment, the addition of diffusion filter 27 changes the continuous zoom range to 20° in narrow angle to 75° in wide angle.

Figure 5:
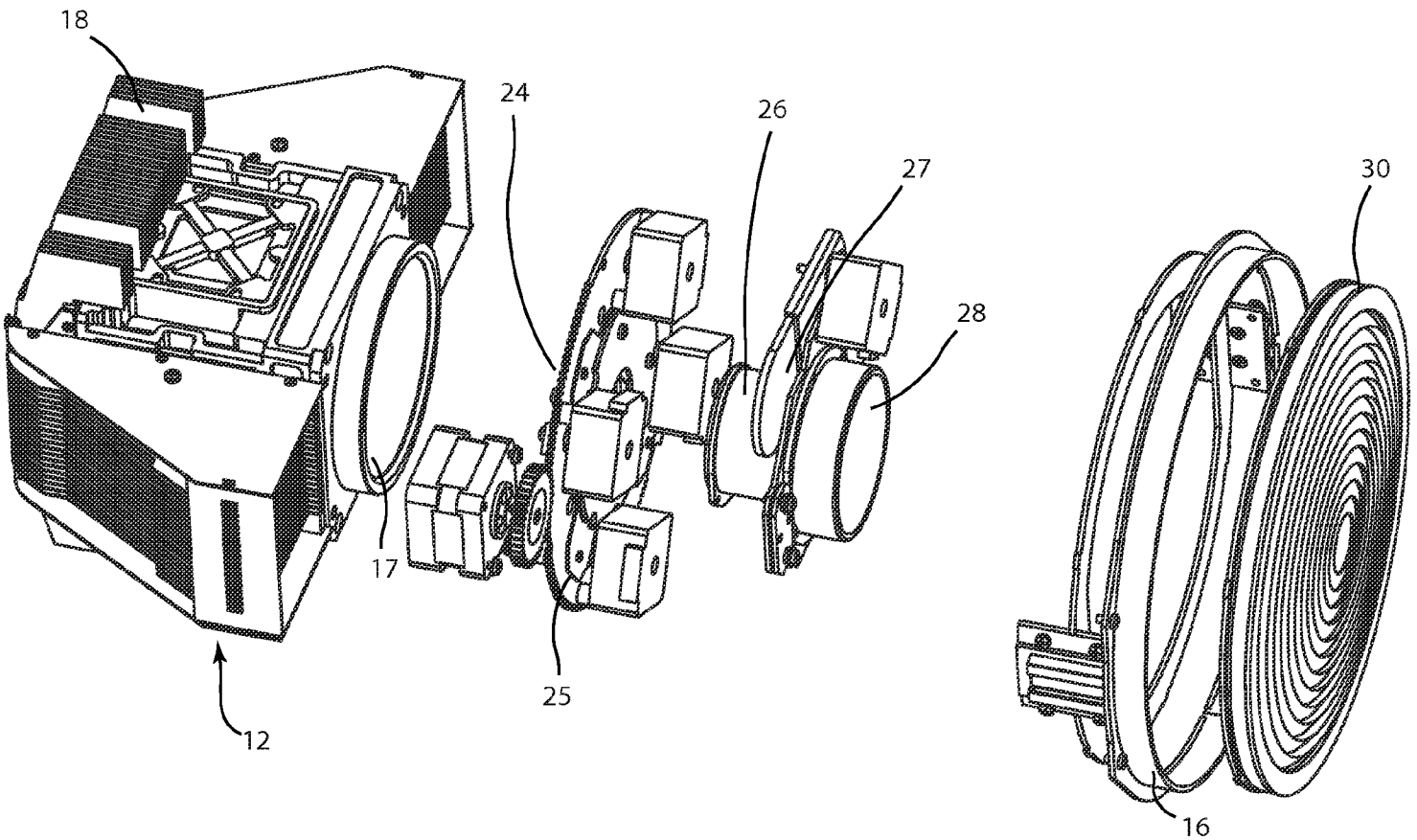
FIG. 5 illustrates select components of an embodiment of an improved beam framing system in an automated luminaire with an LED light source.

FIG. 5 illustrates select components of an embodiment of an improved beam framing system in an automated luminaire with an LED light source. In this embodiment, the light source is an LED light source 18, which may have integrated optics 17. LED light source 18 may be a single color light source comprising, for example, white LEDs, or may comprise multiple colors of LEDs such as red, green and blue (RGB), or red, green, blue and white (RGBW) or any other combination of colored LEDs, whose output may be independently varied and mixed to provide any desired color. The optical system disclosed provides homogenization of the individual colors such that the output beam is of a single color, with no colored patterning or colored shadows. FIG. 5 illustrates the system in a narrow angle configuration where output lens 30, and first and second lenses 26 and 28 move to provide zoom and focus. Diffusion filter 27 may also optionally be inserted in the optical path to improve the homogenization and to further increase the maximum output angle. Framing shutters 25 may provide either a hard edged focused occlusion or a soft edged wash occlusion. The insertion of diffusion filter 27 in the optical path may further soften the projected edge of framing shutters 25. Diffusion filter 27 may be mounted on an arm or on other suitable articulation means such that it may be inserted or removed from the optical path as desired by the user to improve the homogenization and to further increase the maximum output angle. It is here illustrated removed from the optical path.

Output lens 30 may be a conventional Fresnel lens or may be a Fresnel lens with a greatly increased number of circumferential facets. Output lens 30 may also be provided with either a planar rear surface or with a break-up or stippling pattern molded into the rear surface. If a Fresnel lens with a planar rear surface is used then the optical system herein disclosed may provide sharply focused images of imaging components 25 whereas a lens with a stippled back will provide softened, diffused images.

Figure 6:
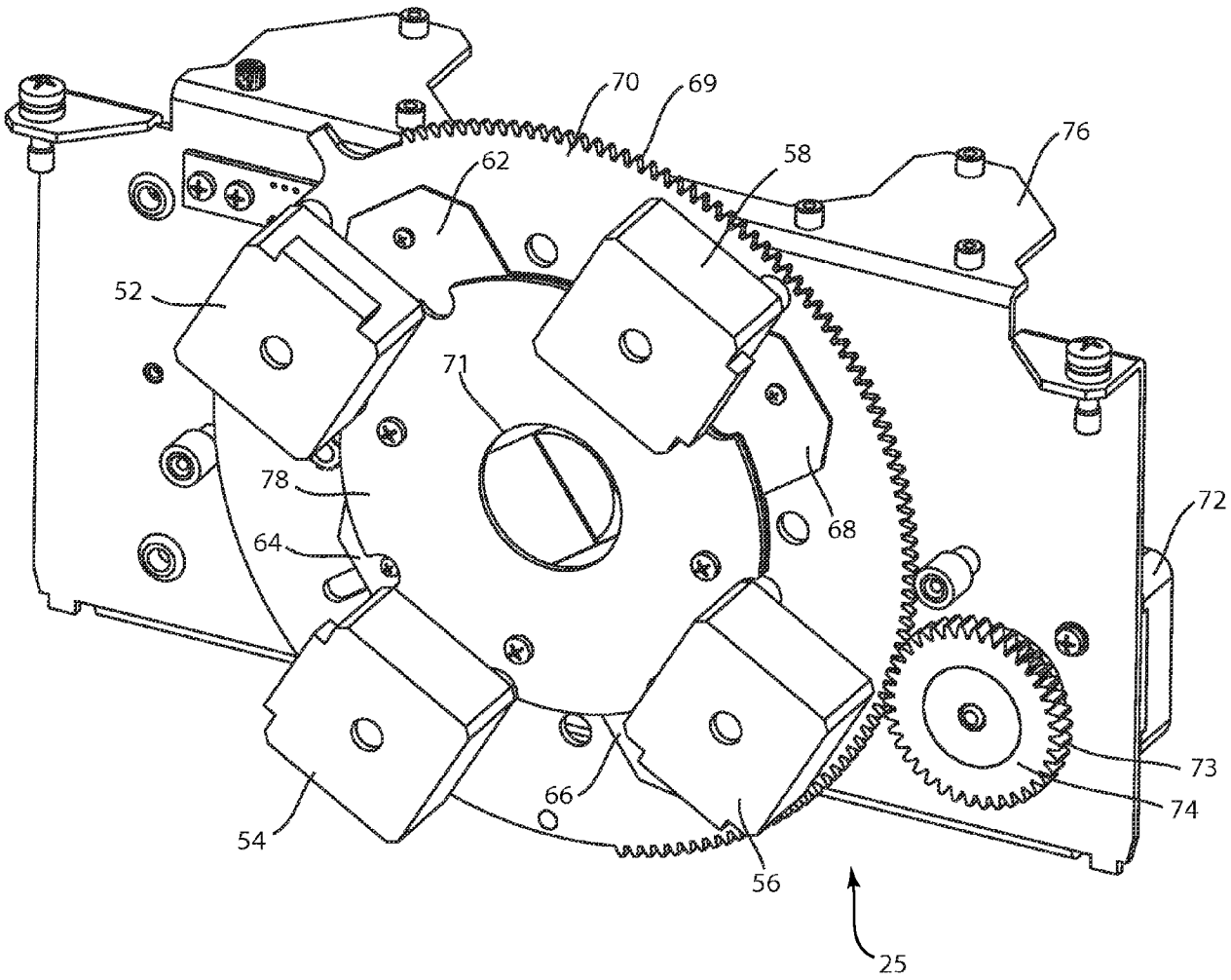
FIG. 6 illustrates a view of an embodiment of the invention.

FIG. 6 illustrates a view of the framing shutters 25 of an embodiment of the invention. Framing shutters 25 may comprise a frame 76 which may be mounted within the luminaire. Central aperture 71 constrains the main light path for the optical system of the luminaire. The central aperture 71 and framing shutters 25 are positioned at a point in the optical train such that the output optics may provide either a hard edge focus or a soft edge focus of the shutter blades in the output beam. Shutter blades 62, 64, 66 and 68 are framing shutter blades. Each of the shutter blades 62, 64, 66 and 68 may be separately and independently moved across the central aperture 71 through the respective operation of motors 52, 54, 56 and 58. In further embodiments the blade movement may be effected through cams, gears, sliders, linear actuators, linkages, or other mechanisms well known in the art to provide linear motion, without detracting from the invention. Each of the shutter blades 62, 64, 66 and 68 may be guided and constrained in movement to a single linear axis radial to the central aperture 71, and prevented from rotation, through guide pins, plates, or rails attached to top plate 78 and/or backing plate 70.

In the embodiment shown in FIG. 6, shutter blades 62, 64, 66 and 68 and their associated motor and drive systems may be mounted on backing plate 70. Backing plate 70 and the framing shutter system complete with blades and motors may further be rotated in its entirety about central aperture 71 by gear 74 driven by motor 72. In the embodiment shown, the backing plate 70 has gear teeth 69, which mesh with the gear teeth 73 of the gear 74. Although a gear system is illustrated for the rotation of backing plate 70, the invention is not so limited and any system for rotating backing plate 70 may be utilized. In other embodiments, the backing plate rotation may be effected through direct drive, belt drives, friction drives, or other mechanisms well known in the art. In the illustrated embodiment of the invention, motors 52, 54, 56, 58 and 72 are stepper motors. In other embodiments, other motors or drives such as servo motors or linear actuators may be employed as well understood in the art. In the system illustrated the rotation of backing plate 70 and thus the framing system is restricted to 180°. However, the invention is not so limited and any rotation angle, up to and including a full 360°, or fully continuous rotation is possible.

Figure 7:
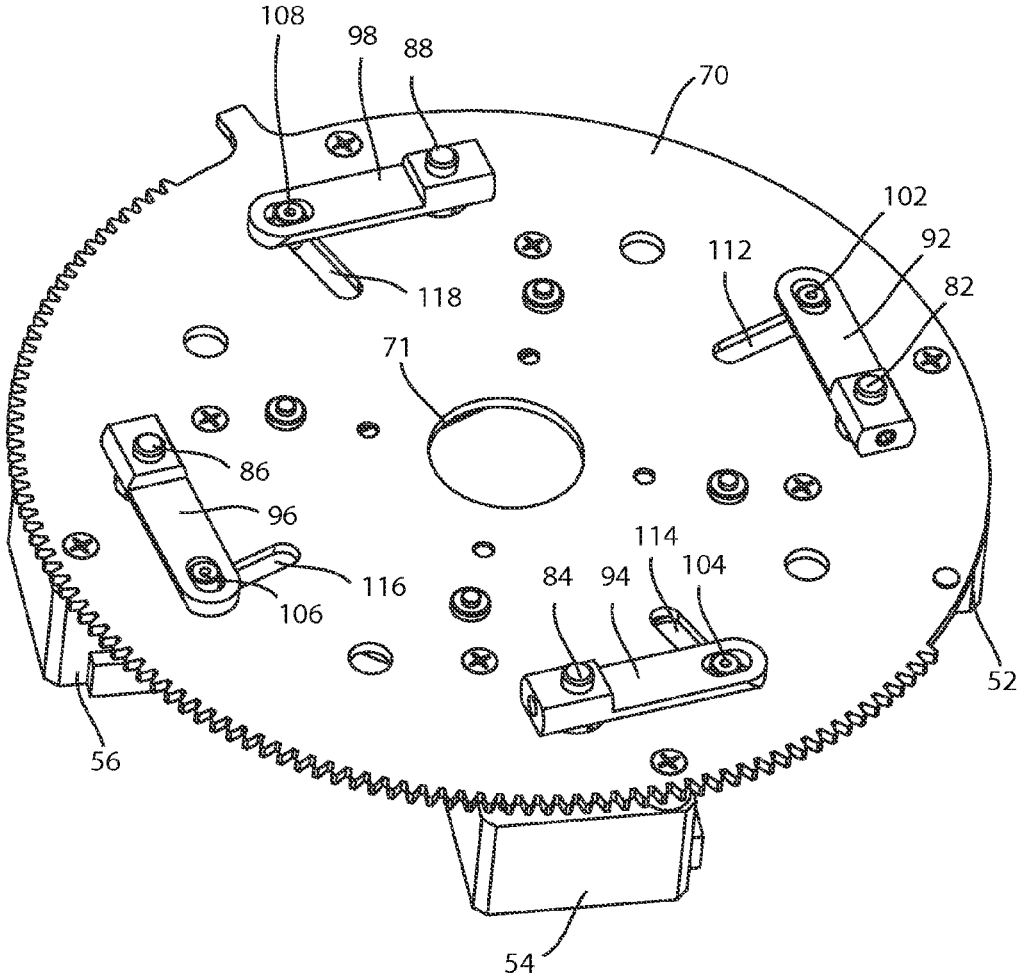
FIG. 7 illustrates a view of the rear surface of an embodiment of the invention with all blades fully retracted.

FIG. 7 illustrates a view of the rear surface of an embodiment of the invention with all blades fully retracted. Lever arms 92, 94, 96, and 98 are fixed to the output shafts 82, 84, 86, and 88 of their respective motors 52, 54, 56, and 58 (not shown). Taking a single motor, 54, as an example. When motor 54 rotates, its output shaft 84 also rotates. This causes lever arm 94 to turn and to transfer that rotary motion into a linear motion of pin 104 which is attached to a shutter blade. Pin 104 is constrained by slot 114 in backing plate 70 to move in a straight line. Similarly, motors 52, 56, and 58 (not shown) transfer their rotary motion to linear motions of associated shutter blade pins 102, 106, and 108 constrained by slots 112, 116, and 118. In the position illustrated in FIG. 7, all motors 52, 54, 56, and 58 (not shown) are rotated fully clockwise and all pins 102, 104, 106, and 108 are at the outer ends of slots 112, 114, 116, and 118.

Figure 8:
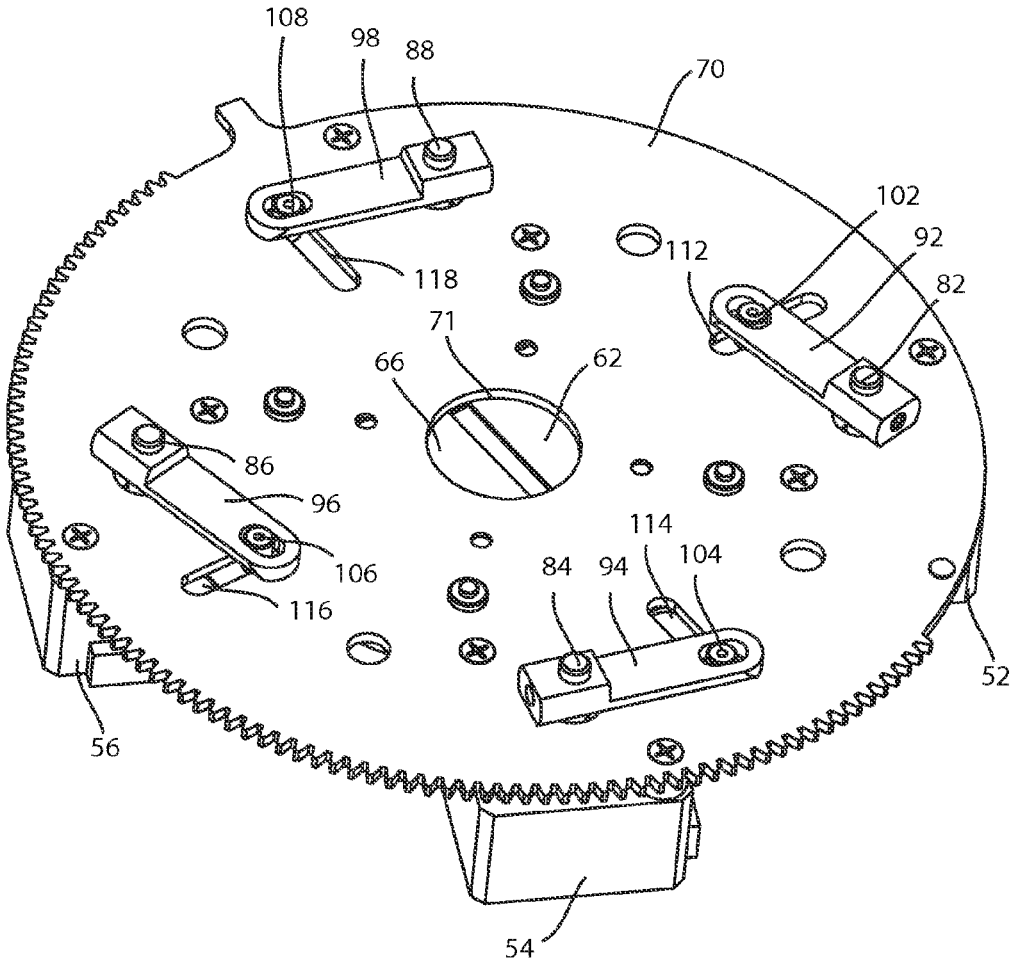
FIG. 8 illustrates a view of the rear surface of an embodiment of the invention with two blades partially inserted.

FIG. 8 illustrates a view of the rear surface of an embodiment of the invention with two blades partially inserted. In the position illustrated in FIG. 8, motor 56 is partially rotated such that output shaft 86 and lever arm 96 are also partially rotated. This rotation is translated to linear motion of pin 106 constrained by slot 116 so as to move shutter blade 66 so as to partially occlude central aperture 71. Similarly motor 52 is partially rotated such that output shaft 82 and lever arm 92 are also partially rotated. This rotation is translated to linear motion of pin 102 constrained by slot 112 so as to move shutter blade 62 so as to partially occlude central aperture 71. The remaining two motors 54 and 58 (not shown) remain rotated fully clockwise such that pins 104 and 108 are at the outer ends of slots 114, and 118, respectively.

Figure 9:
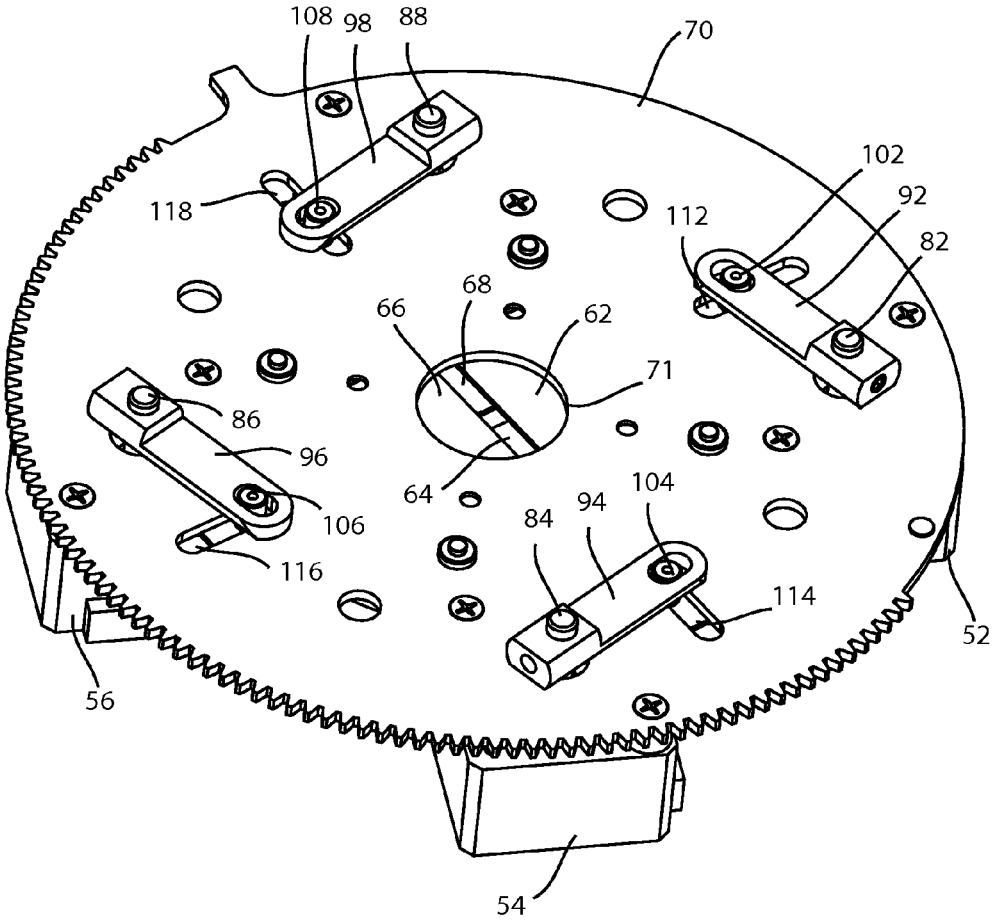
FIG. 9 illustrates a view of the rear surface of an embodiment of the invention with all blades partially inserted.

FIG. 9 illustrates a view of the rear surface of an embodiment of the invention with all blades partially inserted. In the position illustrated in FIG. 9, motor 56 is partially rotated such that output shaft 86 and lever arm 96 are also partially rotated. This rotation is translated to linear motion of pin 106 constrained by slot 116 so as to move shutter blade 66 so as to partially occlude central aperture 71. Similarly, motors 52, 54, and 58 are partially rotated such that output shafts 82, 84 and 88 and lever arms 92, 94 and 98 are also partially rotated. This rotation is translated to linear motion of pins 102, 104, and 108 constrained by slots 112, 114 and 118 so as to move shutter blades 62, 64, and 68 so as to partially occlude central aperture 71.

Shutter blade 62 and shutter blade 66 may be in the same focal and mechanical plane. The luminaire firmware controlling the rotation of associated motors 52 and 56 ensures that the movement of the two blades is coordinate such that collisions cannot occur. Similarly shutter blades 64 and 68 may be in the same focal and mechanical plane. The luminaire firmware controlling the rotation of associated motors 54 and 58 ensures that the movement of the two blades is coordinate such that collisions cannot occur. Shutter blade 62 and shutter blade 66 may be in a different focal and mechanical plane to shutter blades 64 and 68 such that each pair may freely pass above or behind the other, perpendicular, pair without fear of collision.

Figure 10:
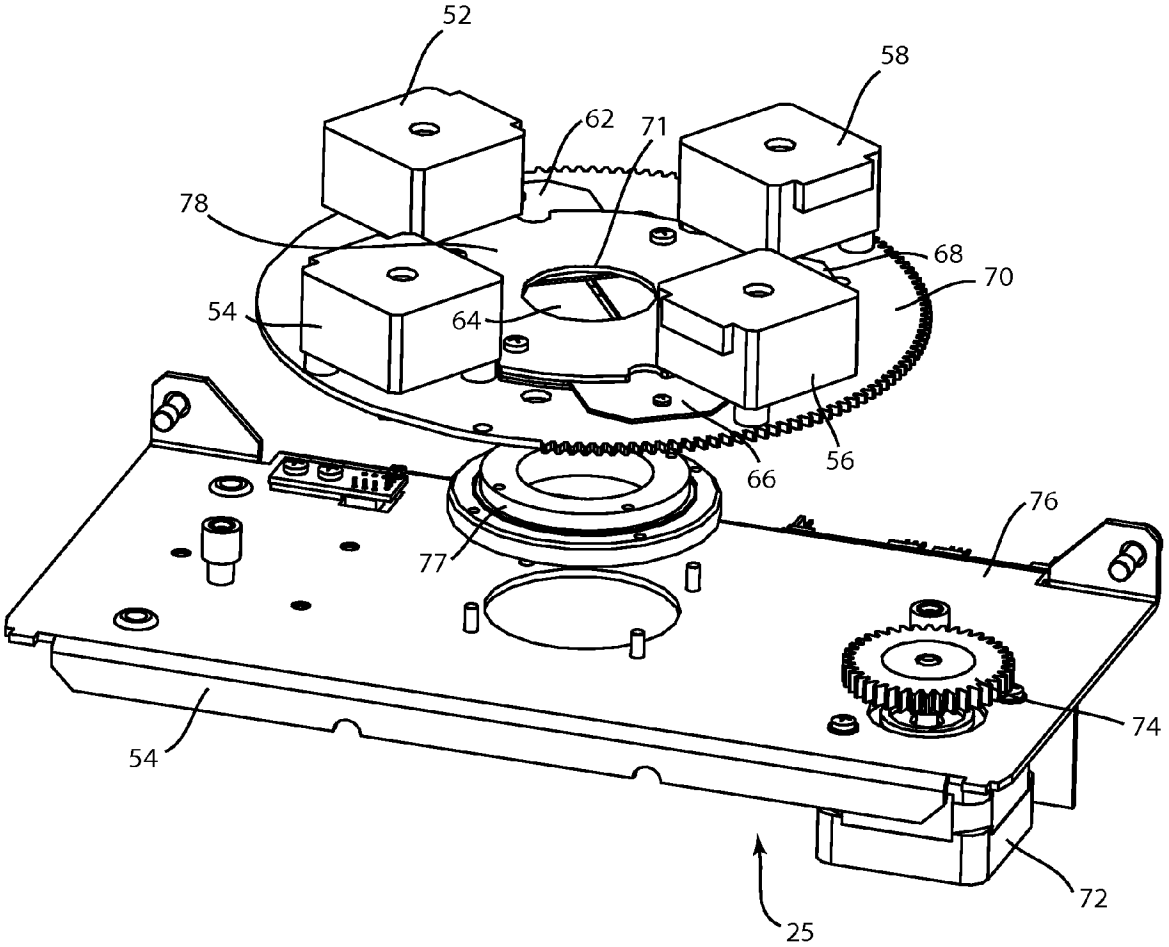
FIG. 10 illustrates an exploded view of an embodiment of the invention.

FIG. 10 illustrates an exploded view of the framing shutters 25 of an embodiment of the invention. Framing shutters 25 may comprise a frame 76 which may be mounted within the luminaire. Central aperture 71 provides the main light path for the optical system of the luminaire. The central aperture 71 and framing shutters 25 are positioned at a point in the optical train such that the output optics may provide either a hard edge focus or a soft edge focus of the shutter blades in the output beam. Shutter blades 62, 64, 66 and 68 are framing shutter blades. Each of the blades 62, 64, 66 and 68 may be separately and independently moved across the central aperture 71 through the respective operation of motors 52, 54, 56 and 58. In the embodiment shown in FIG. 10, shutter blades 62, 64, 66 and 68 and their associated motor and drive systems may be mounted on backing plate 70. Backing plate 70 and the framing shutter system complete with blades and motors may further be rotated in its entirety about central aperture 71 by gear 74 driven by motor 72. In the embodiment shown, the backing plate 70 has gear teeth, which mesh with the gear teeth of the gear 74. Backing plate 70 is rotatably mounted to frame 76 through bearing assembly 77. Prior art systems often support such rotating assemblies on a plurality of small bearings situated around the periphery of backing plate 70, however a single large central bearing assembly 77 provides advantages in speed, accuracy, and smoothness of the rotational movement. Bearing assembly 77 may be a ball bearing, roller bearing, or other bearing system as well known in the art. In the system illustrated, the rotation of backing plate 70 and thus the framing system is restricted to 180°. However, the invention is not so limited and any rotation angle, up to and including a full 360°, or fully continuous rotation, is possible.

Figure 11:
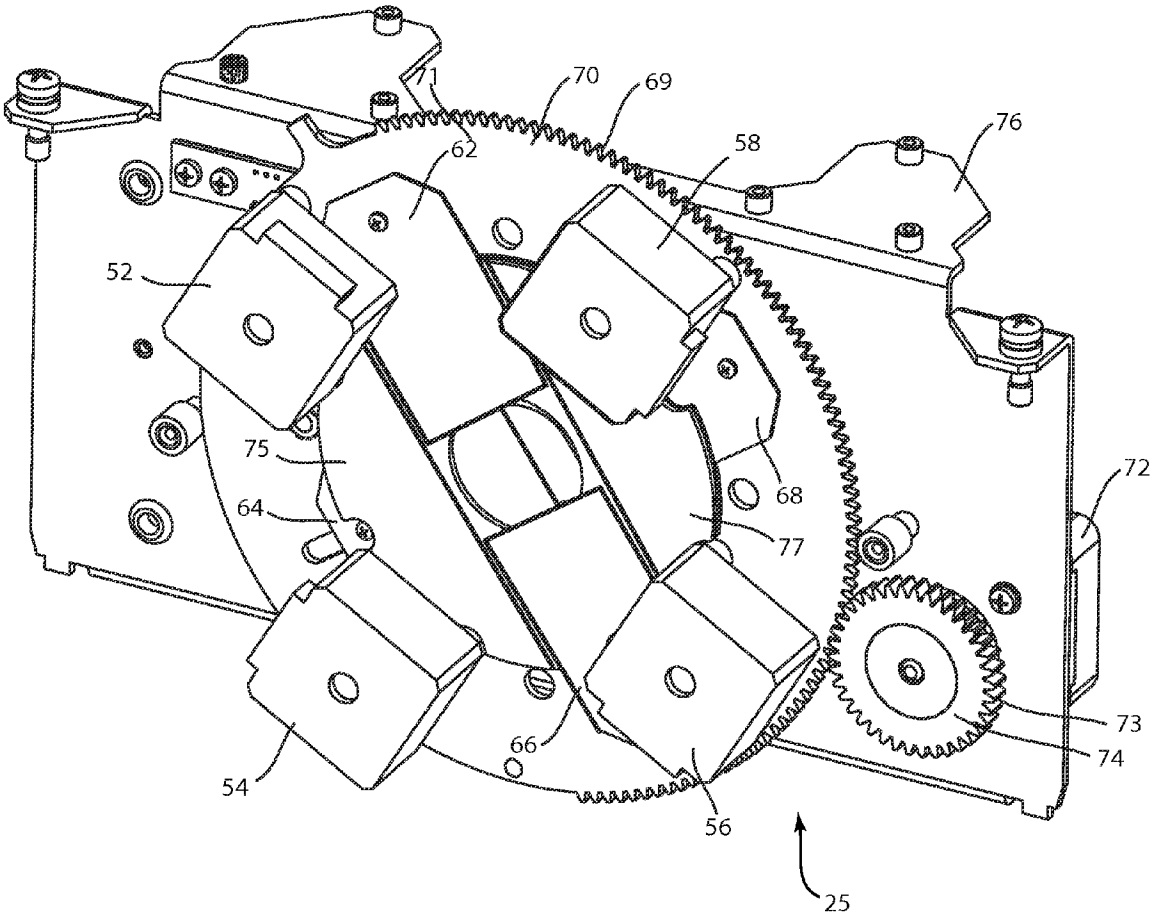
FIG. 11 illustrates a view of an embodiment of the invention.

FIG. 11 illustrates an embodiment of the invention with top plate 78 removed revealing the underlying mechanism of shutter blades 62 and 66. Guide plates 75 and bearing assembly 77 serve to guide and align shutter blades 62 and 66 such that they remain parallel and in-line with each other. Similar guide plates (not shown) serve to guide and align shutter blades 64 and 68.

The invention as disclosed provides a simple framing system for either a hard edge or wash luminaire capable of providing shuttering and beam control. Each blade may be moved linearly to partially occlude an optical aperture of the luminaire. Additionally, the entire framing mechanism may be rotated about that optical aperture.

While the disclosure has been described with respect to a limited number of embodiments, those skilled in the art, having benefit of this disclosure, will appreciate that other embodiments may be devised which do not depart from the scope of the disclosure as disclosed herein. The disclosure has been described in detail, it should be understood that various changes, substitutions, and alterations can be made hereto without departing from the spirit and scope of the disclosure.

The invention claimed is:

1. An automated luminaire with a spot light mode, a wash light mode, and a planar framing shutter blade system comprised of a light modulation system configurable to generate hard edge spot light beam characteristic or soft wash light beam characteristics, and a plurality of framing shutter blades that are constrained to operate in parallel planes each articulated via a single member linkage with a single link to the shutter blade, where the framing shutter system is supported by a single central bearing assembly and is rotatable about an axis of the light beam.

2. The automated luminaire of claim 1, with a non-glass output lens which can nest inside a main housing body of the luminaire and extend out from frontal confines of the luminaire during use.

3. The automated luminaire of claim 1, wherein the linkage further comprising a single member pivot arm/lever linear actuator.

4. The automated luminaire of claim 1, wherein a framing shutter system is rotatable over ¼ rotation about a light beam axis.

5. The automated luminaire of claim 3 where the pivot arm has a pivot pin linkage on one end and a slot pin linkage on the other end.

6. An automated luminaire comprising:

optics that can be remotely configured to operate in a spot light mode and reconfigured to operate in a wash light mode; and a planar framing shutter system with a single, single member linkage which brings the shutter in and out of the light beam with a constrained single degree of freedom and a rotating carrier which rotates the shutters over ¼ a revolution giving their movement relative to the light beam a second/rotational degree of freedom, where the rotating carrier is supported by a single central bearing assembly, and whereby when the luminaire is in a spot light mode the shutter system performs as a framing shutter and when the luminaire is in a wash light mode the shutter system affects the light beam like barn door shutters.

* * * * *